United States Patent [19]

Wegener et al.

[11] 4,272,856

[45] Jun. 16, 1981

[54] DISPOSABLE AIR-BEARING PATIENT MOVER AND A VALVE EMPLOYED THEREIN

[75] Inventors: Jack Wegener, 830 Chambers Ave., Gloucester City, N.J.; Raynor A. Johnson, Newark, Del.

[73] Assignee: Jack Wegener, Gloucester City, N.J.

[21] Appl. No.: 70,464

[22] Filed: Aug. 28, 1979

[51] Int. Cl.[3] ..... A47C 27/08; B63C 7/10

[52] U.S. Cl. ..... 5/81 R; 5/431; 5/451; 180/116

[58] Field of Search ..... 5/81 R, 81 B, 431, 451, 5/457–468, 482, 484; 180/116, 124, 125, 128

[56] References Cited

U.S. PATENT DOCUMENTS

| | | | |
|---|---|---|---|
| 3,739,407 | 6/1973 | Stiller | 5/81 B |
| 3,780,823 | 12/1973 | Michaud et al. | 180/124 |
| 4,051,565 | 10/1977 | Berge | 5/431 |
| 4,064,577 | 12/1977 | Walters | 5/484 |
| 4,104,425 | 8/1978 | Hirmann | 5/81 R |

*Primary Examiner*—Casmir A. Nunberg

*Attorney, Agent, or Firm*—Sughrue, Rothwell, Mion, Zinn and Macpeak

[57] ABSTRACT

A thin flexible film bag, oriented horizontally or integral therewith and preferably bearing an absorbent material chuck on its upper wall, forms a plenum chamber. A lower wall underlying the chuck and including small diameter perforations to create an air bearing for supporting the patient mover. The patient borne thereby lies on the chuck, some distance from an underlying fixed planar support surface. This permits the patient to be readily moved in a frictionless manner when air under pressure fills the plenum chamber and escapes through the perforations. Air enters the plenum chamber through an outer tube of thin, flexible material. Paired, opposed, flat and less flexible tongues define a short inner tube, being positioned within the outer tube, to permit airflow entry to the plenum chamber with the tongues being deflected away from each other. The tongues are pressed against each other and one side of the outer tube wall, due to elastic memory, to prevent air escape from the chamber at that point. The patient mover includes features of controlled pillowing, use of a generally rigid backing member underlying the load, and air dispersion throughout the chamber to insure jacking of the patient during pressurization of the plenum chamber.

9 Claims, 7 Drawing Figures

FIG. 3
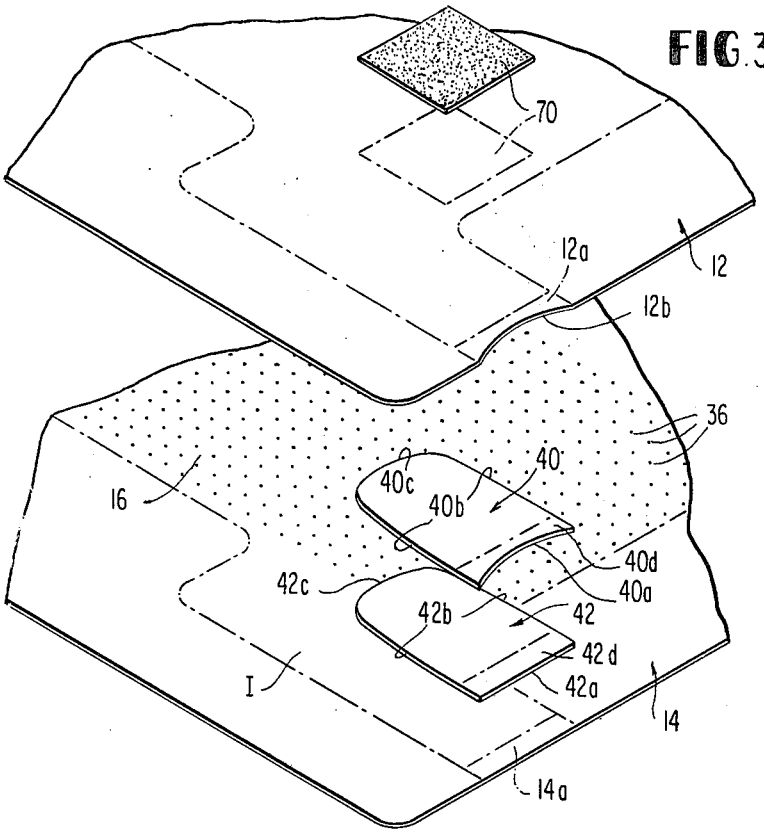
FIG. 7
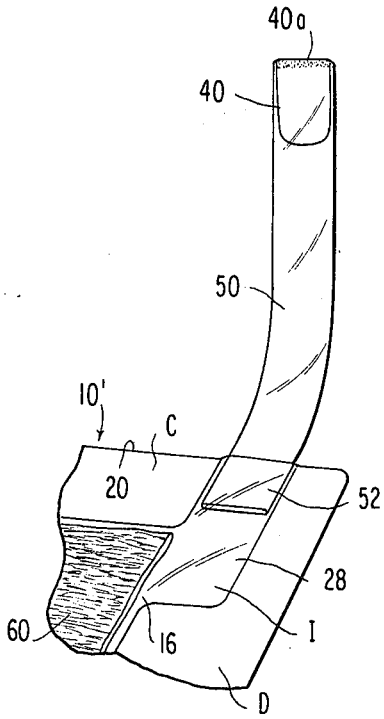
FIG. 4
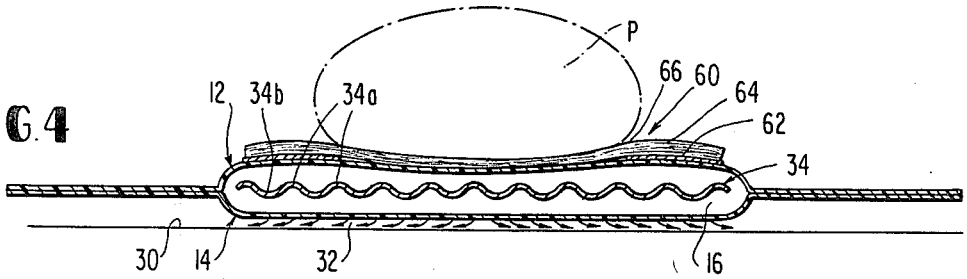
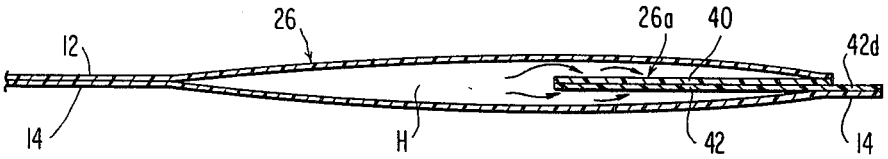
FIG. 5
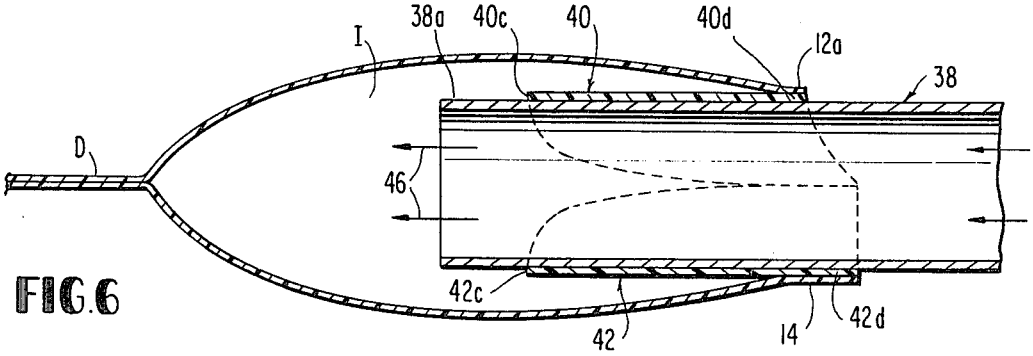
FIG. 6

DISPOSABLE AIR-BEARING PATIENT MOVER AND A VALVE EMPLOYED THEREIN

FIELD OF THE INVENTION

This invention relates to patient movers for emergency use in the field, for ambulance transport of injured personnel and for patient moving to and from a hospital bed, X-ray table, operating table or the like and, more particularly, to the utilization of a patient mover of a disposable planar air pallet type.

BACKGROUND OF THE INVENTION

In recent years, material handling devices have been devised in the form of low-cost planar air pallets employing flexible film plastic material in either sheet or bag form for the transport of material in lieu of conventional wooden pallets. U.S. Pat. No. 3,948,344, entitled "Low Cost Planar Air Pallet Material Handling System," issuing Apr. 6, 1976, is exemplary of such planar air pallets formed of flexible sheet material. Planar air pallets of this type employ at least one flexible material sheet for partially defining a plenum chamber, with that sheet being perforated as by way of small pinholes over a central surface area which faces an underlying fixed, generally planar support surface, such as a building floor. The escape of air under pressure through the perforations which open up directly to the interior of the plenum chamber acts initially to jack the load above that flexible sheet and to create an air bearing of relatively small height between the floor and the perforated flexible sheet. In devices such as those provided within the reference patent, due to cracks within the surface over which the air bearing or air cushion moves as well as projections and irregular contouring of that floor or support surface, it is necessary to provide controlled pillowing of the flexible film defining a portion of the plenum chamber, and to establish by jacking the load to a predetermined height, the ability of the air pallet to ride over such surface projections, while preventing ballooning of the flexible sheet or film portion of the plenum chamber which would result in tilting and thus rolling of the load off the top of the air pallet. Further, where the load is resting upon the air pallet prior to pressurization of the plenum chamber, the load tends to press the perforated flexible sheet into contact with the floor and prevent the entry of air under pressure and escape of the air through the perforations to form an air film of predetermined height to thus create the air bearing for the air pallet.

There is a requirement to provide air dispersion means either interiorly of the plenum chamber or by way of positive members attached to the exterior surface of the flexible sheet or other members defining the plenum chamber such that air entering through an inlet within a wall of the plenum chamber may disperse throughout the plenum chamber and effect jacking of the load and creation of the air bearing. Further, where there are multiple air inlets to the plenum chamber permitting versatility in the point of application of air under pressure, as from compressor, through a supply tube, such as a vacuum cleaner wand (using positive air pressure rather than vacuum to the wand), it is conventional to employ some type of valve member to close off the unused inlet. This is achieved automatically by the utilization of air pressure within the plenum chamber. In the reference patent, this has been achieved by the provision of a flap formed at the air inlet as an extension to one of the thin, flexible sheets defining a wall of the plenum chamber, such as the flexible sheet bearing the perforations and creating the air bearing, with that flap being a bent over a portion of the sheet internally of the inlet, projecting inwardly of the plenum chamber and contacting an overlying or underlying opposed sheet or wall member to seal off and prevent the escape of air through the slit between the sheets defining the air inlet at that point.

Further, the air pallet of the reference patent takes various forms, including in one form a single, flexible sheet which is bonded to the load about the periphery of the sheet and with the load itself forming one wall of the plenum chamber and constituting a relatively rigid backing member. Alternatively, a flexible, plastic film bag, such as a "garbage bag," is employed to form both the upper and lower walls of the plenum chamber and with the lower wall being perforated to define the air bearing and wherein the bag is fixed to the bottom of the load. The air inlet in this case normally comprises the open end of the bag which sealably receives the wand or air supply tube.

In these air pallets, the air dispersion means may comprise a corrugated sheet interposed between the load itself and the single, flexible sheet bearing the perforations in the load bearing area of the air pallet, or the air dispersion means may constitute a corrugated or other irregular surface planar sheet carried internally of the air bag and providing additionally, the generally rigid backing surface for the load.

In the medical field, there is a continuing need to easily, safely and comfortably transport an injured person, hospital patient or the like, such as removing the injured person from the scene of the accident, placement of that person within an ambulance, transportation of the patient within the ambulance to the hospital, transfer of the patient to the operating table and placement of the patient on an hospital bed. Further, there is a very great need for simplified means for moving the patient on the bed to change the bed clothes and to support the patient with maximum comfort and to minimize the possibility of the development of bed sores during long stays in the hospital. Such mechanism must be one in which the material contacting the patient can be readily disposed of and has the capacity to absorb liquid since patients often experience loss of bodily fluids with resultant messing of the bed linen and the like. Further, because of the necessity to prevent transmission of disease, there is the further necessity to provide a low-cost, "throw-away" disposable pad or stretcher cover which can be readily replaced from patient to patient.

The medical supply field has developed rectangular laminated sheet structures known in the art as "chucks" which are comprised of an underlying liquid impervious or non-porous plastic film bearing a soft porous sheet material layer and covered by a gauze sheet, which laminated structure is placed directly beneath a patient, either on a hospital bed or under similar circumstances. This allows the chuck to be readily disposed of subsequent to its use as when soiled or when the equipment bearing the chuck receives a new patient.

It is, therefore, a primary object of the present invention to provide an improved patient mover which facilitates the movement of a patient or accident victim and permits the patient to be physically moved in a relatively frictionless manner.

It is a further object of the present invention to provide an improved patient mover which is preferably formed of flexible film material which provides for an air bearing facilitating that frictionless movement of the patient and which preferably incorporates an absorbent material chuck as a material element thereof to provide for the comfort and needs of the patient during such handling.

It is a further object of the present invention to provide an improved low-cost disposable air-bearing patient mover which has application to emergency use at the scene of an accident and which will permit the accident victim to be transported directly from the scene of the accident to the hospital and facilitate patient transport throughout the hospital with minimum disturbance to the patient during such movement.

SUMMARY OF THE INVENTION

The present invention is directed to a patient mover of air-bearing type for low friction movement of a medical patient or the like supported by a generally rigid planar backing member over an underlying generally planar fixed support surface. The patient mover in one form comprises an air bag formed of thin, flexible film material including top and bottom walls defining a plenum chamber. A portion of the bottom wall bears small diameter perforations, with the perforations opening into the plenum chamber. Air dispersion means are provided for insuring airflow throughout the chamber when the pallet is under load at the time of air pressurization. Means are provided for controlling pillowing of the flexible film air bag to permit jacking of the backing member and the medical patient sufficient to permit the patient mover to accommodate surface irregularities for both the load support surface and the backing member and without ballooning.

Air inlet means are provided to the chamber at at least one point for permitting air under pressure to enter the chamber for jacking the load and for discharge through the perforations to create an air film between the bottom wall and the fixed support surface. The top wall preferably carries a porous fabric chuck overlying the load bearing area of the bag as defined by the perforations within the bottom wall. The air inlet means comprises at least one outer tube formed of thin, flexible film material and an inner tube mounted coaxially within the outer tube and comprises of opposed flexible tongues sealed at the ends remote from the plenum chamber to opposite sides of the outer tube with the inner ends being free of each other and from the outer tube. The tongues constitute strips of a material of less flexibility such that during air entry into the plenum chamber through the inlet means, the tongues take the curved configuration of the outer tube and are in contact therewith, and after pressurization of the plenum chamber, air tending to escape through the inlet means causes the tongues to move away from one of the outer tube walls and to press against each other and against the other of the outer tube walls and thereby to close off the inlet means.

The generally rigid backing member may comprise a generally rigid planar member positioned internally of the bag, and the air dispersion means comprise irregularities within the surface of the rigid member so as to cause the bag film material to be displaced from contact with the rigid member along portions thereof to form transverse air passages to permit air dispersion when air enters the at least one air inlet means.

The air bag may comprise top and bottom flexible sheets thermally bonded about the edges, over surface portions to define a central plenum chamber and forming the outer tube of integral inlet means. The inner tube comprises separate strips of less flexible sheet material sealed to the top and bottom sheets respectively, along their lateral edges at their ends remote from the plenum chamber. The less flexible strips defining the inner tubes preferably are rounded on their ends proximate to the plenum chamber. The peripheral edges of the top and bottom sheets which are thermally bonded to each other may define pull tabs to permit grasping of the patient mover for transport of the medical patient over the generally fixed planar support surface by pulling force application. The air inlet means may further comprise an elongated outer tube sealed to the sheet periphery, interposed between the top and bottom sheets, and opening to the plenum chamber, with the inner tube strips carried by the outer tube, axially remote from the area of contact with the top and bottom sheets.

BRIEF DESCRIPTION OF THE DRAWINGS

FIG. 3 is an exploded perspective view of one corner of the air-bearing patient mover of FIGS. 1 and 2.

FIG. 4 is a vertical sectional view of the air-bearing patient mover of FIG. 2 taken about line 4—4.

FIG. 5 is a vertical sectional view of a portion of the air-bearing patient mover of FIG. 1 taken about line 5—5 showing the nature and operation of the improved air valve employed therein, with the valve closed upon pressurization of the plenum chamber.

FIG. 6 is a sectional view taken about line 6—6 of FIG. 1 showing the position of the valve elements upon insertion of the air supply wand into the air inlet and pressurization of the plenum chamber.

FIG. 7 is a perspective view of a portion of a second embodiment of the present invention.

DESCRIPTION OF THE PREFERRED EMBODIMENTS

Referring to FIGS. 1–6 inclusive, there is shown one embodiment of the present invention in the form of a patient mover constituted essentially of bag form, indicated generally at 10, and defined principally by a top, thin, flexible sheet indicated generally at 12 and a bottom, thin, flexible sheet indicated generally at 14. Both sheets may be formed of similar flexible film material, such as polyvinyl chloride or polypropylene, of several mills thickness and being of a material preferably permitting sealing of the sheets about their peripheries by the localized application of heat to thermo-bond the sheets together, thereby defining a cavity at the center constituting an air plenum chamber 16. Further, for the purposes of the present invention, the thermo-bonding is not only effected on all four sides as in areas A, B, C and D, FIG. 1, but thermo-bonding is purposefully prevented in a central area E forming the plenum chamber 16 but additionally from the opposed longitudinal ends 18 and 20 adjacent respective lateral corners, and longitudinally to the extent where the non-bonded areas F, G, H and I open to and are integral with the central non-bonded area E. Thus, the non-bonded areas F, G, H and I define outer flexible tubes 22, 24, 26 and 28 constituting in this case four air inlets to the air-bearing patient mover plenum chamber 16.

Figure 1:
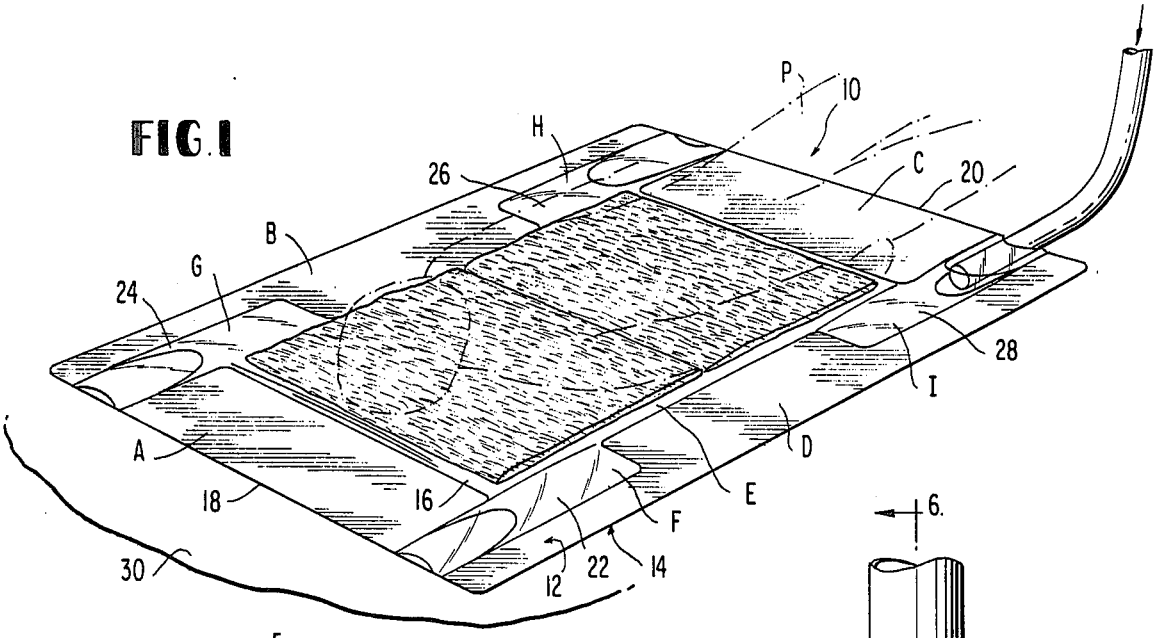
FIG. 1 is a perspective view of one embodiment of the air-bearing patient mover of the present invention during air pressurization of the plenum chamber.
Figure 2:
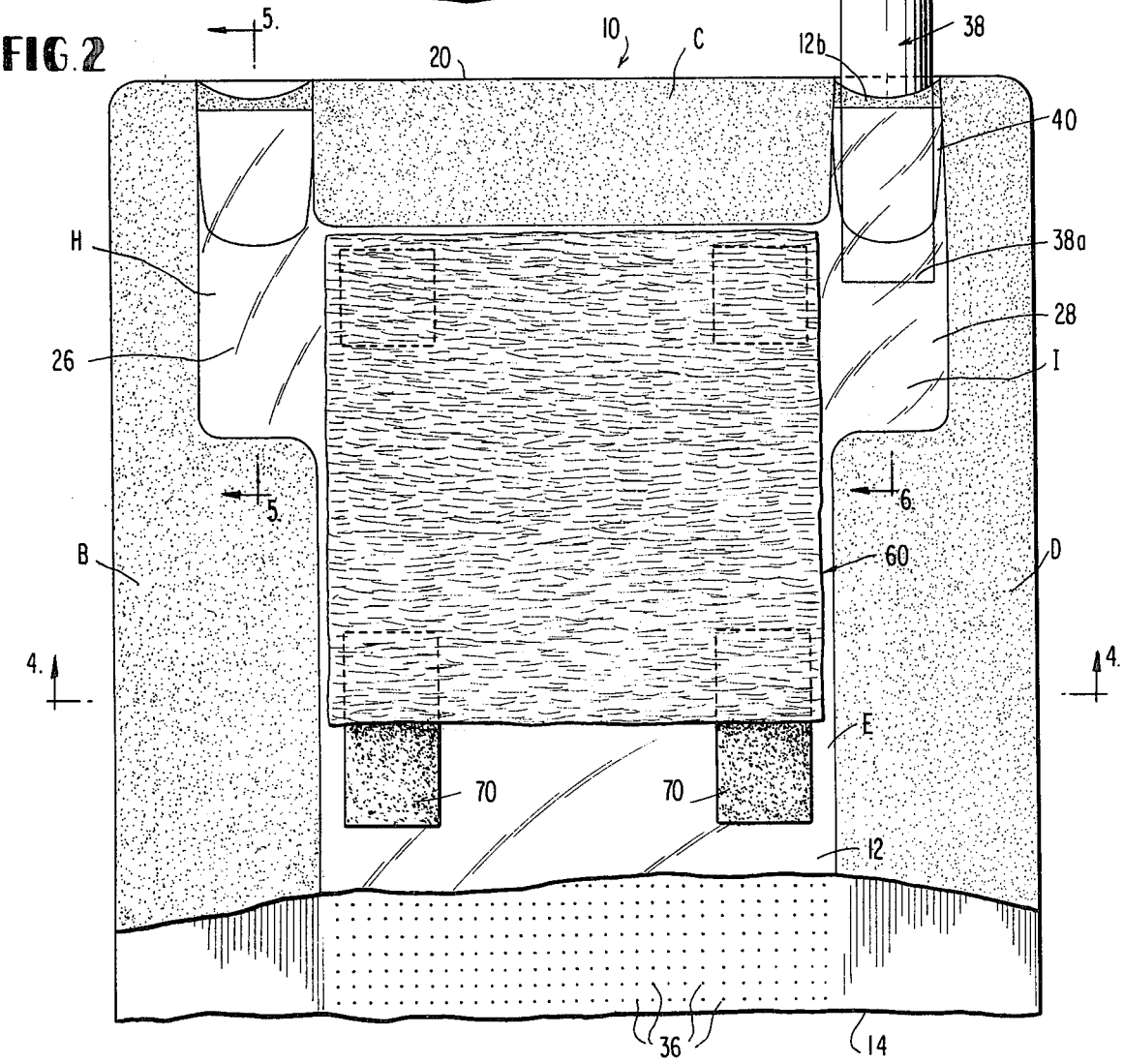
FIG. 2 is a top plan view partially broken away of a portion of the air-bearing patient mover of FIG. 1.

In the illustrated embodiment of the invention, FIGS. 1–6, in order to provide a relatively rigid backing member and so as to prevent the patient P, FIG. 1, from bottoming out, the air bearing at any point on the relatively fixed support surface as defined by floor 30 upon which the patient P and the patient mover 10, arrive on the film of air as at 32, as illustrated by arrows 32, FIG. 4, a corrugated board 34 of rectangular configuration and being sized slightly less than the rectangular plenum chamber 16 is positioned within this plenum chamber and between the top, flexible film 12 and the bottom flexible film 14. Further, the corrugations not only add rigidity to the board 34 but provide, due to the corrugations, transverse hills 34*a* and valleys 34*b* constituting the air dispersion means necessary to insure full pressurization of the plenum chamber 16, jacking of the patient mover 10, and the jacking of the patient P by pressure within the plenum chamber which raises the top, flexible film 12 away from the bottom flexible film 14, and the subsequent creation of the air bearing as at 32 due to the escape of air through a plurality of small diameter, pinhole-type perforations as at 36, which define the load-bearing areas for the air bearing as at 32 for the patient mover.

An important aspect of the present invention resides in the means for effectively pressurizing the plenum chamber 16 and developing the air bearing as at 32, this being achieved by the application of air pressure from a suitable compressor through an air delivery tube or wand 38 having an outer diameter slightly less than the diameter of the outer tubes 22, 24, 26 and 28, with the end 38*a* of the wand being projected partially into one of the outer tubes as at 28 at longitudinally spaced, transverse or lateral edge 20 of the patient mover 10. In the illustrated embodiment, FIG. 1, the wand 38 is supplying air to plenum chamber 16 through the upper right-hand corner outer tube 28. Further, since that tube has been selected as the tube to deliver air to plenum chamber 16, air must be prevented from exiting the plenum chamber through the outer tubes 22, 24 and 26 which act as alternate air inlet means.

In that regard, the air-bearing patient mover is provided with an improved air valve formed by inner tubes indicated generally at 22*a*, 24*a*, 26*a* and 28*a* mounted within respective outer tubes 22, 24, 26 and 28. The nature and make-up of air inlet means and the air valve may be more readily appreciated by reference to FIGS. 1–6 inclusive. The inner tube 28*a*, FIG. 3, being formed in this case by upper and lower flexible sheet material strips or tongues 40 and 42 defining an inner tube in each instance and acting in conjunction with outer tube 28 to define an automatic, air pressure closed, valve structure. The strips 40 and 42 have a flexibility which is less than that of the top and bottom sheets 12 and 14, portions of which define each outer tube in the embodiment of the invention illustrated in FIGS. 1–6 inclusive. In addition, it is required of the stips 40 and 42 that they have the property of elastic memory, that is, they are normally flat but may be deflected into curvature transversely of the axis of the dual tube inlet so that they readily conform to the circular or oval cross-section that the outer tube takes during air pressurization, that is, airflow into the plenum chamber through a given inlet. The strips 40 and 42 are of modified rectangular form. One of the strips as at 40 has a curved recessed outer lateral edge 40*a*, has parallel straight longitudinal edges as at 40*b*, and terminates at its inner end in a arcuate or rounded inner lateral edge 40*c*. Further, only a portion of its upper surface, as at 40*d*, is sealed to a portion of the upper sheet 12 as at 12*a*, and, further, a circular cut out or recess 12*b* is provided at this point in this area, conforming to recessed edge 40*a* of strip 40 and facilitating the insertion of the wand 38 therein, FIG. 1, to pressurize the plenum chamber 16. The strips 40 and 42 may be of a thickness in excess to that of the film material flexible sheets 12 and 14, although it is only necessary that they have less flexibility relative to sheets 12 and 14 and elastic memory.

Contrary to strip 40, the strip 42 is provided with a straight outer edge as at 42*a*, parallel longitudinal edges as at 42*b*, and is of the same length and the same width as strip 40. Further, it has a curved inner edge as at 42*c*, conforming to that of the edge 40*c* of the overlying strip 40. Portion 42*d* of strip 42 is adhesively or otherwise bonded, such as thermo-bonded, adjacent its outer edge 42*a* to the lower, thin, flexible sheet 14 as at 14*a*, but is otherwise free of, although in contact with, the underlying sheet, and also under most cases in contact with but totally free of the overlying strip 40. Strip 40 is adhesively fixed or otherwise bonded, as by thermo-bonding to the top, thin, flexible sheet 12, only adjacent its outer edge 40*a*, as at 40*d*, and is free of that flexible sheet 12 throughout the remainder of its length, although it may contact the same during air pressurization of the plenum chamber 16 through that particular inlet to the patient mover. This may be readily seen by contrasting FIGS. 5 and 6.

The strips 40 and 42 may be truly rectangular without the curved inner edges as at 40*c* and 42*c*, respectively. Their outer edges may be flush with each other and with the transverse edges 18 or 20 of thin, flexible sheets 12 and 14 defining the major elements of the air-bearing patient mover 10.

The operation, both when a given inlet acts as the air supply means to the plenum chamber, or when its air valve functions to close off the opening upon air pressurization within the plenum chamber, may be seen by contrasting FIG. 6 to FIG. 5. In FIG. 6, the end 38*a* of the wand 38 is physically projected through the inner tube as defined by strips 40 and 42, which move apart, become arcuate in transverse cross-section and conform generally to the configuration of the outer tube, in this case 26, permitting the air to continue to flow through the outer tube and into the plenum chamber as shown by arrows 44, FIG. 6. Normally, once deflected from a flat configuration to a curved configuration, the strips 40 and 42 tend to conform exactly to the curvature of the more flexible sheet material portions of sheets 12 and 14 which define the outer tube functioning as the air inlet means to the plenum chamber.

At the other three corners, for instance, in FIG. 1, at the portion of the patient mover constituting outer tubes 22, 24 and 26, the air tends to escape through these outer tubes from the plenum chamber 16 which opens directly to the tubes at their inner ends relative to longitudinal edges 18 and 20 of the thin, flexible sheets 12 and 14. An escape path between the top, thin, flexible sheet 12 and strip 40 or between the bottom, thin, flexible sheet 14 and strip 42 tends to maintain both strips 40 and 42 in sealed, pressed contact with each other along their complete length while forcing both strips 40 and 42 to move in unison against one outer tube wall and closing off the opening defined by the outer ends 40*a* and 42*a* of these strips. The elastic memory acts essentially as a spring constant for the strips 40 and 42 to both close off the air passages defined by given outer tubes 22, 24, 26 and 28 unless flow of air is in a direction into the plenum chamber 16, while at the same time, when these strips are forced apart, they tend to take the shape of the article causing that displacement, and, additionally, the configuration of the thin, flexible sheet portions of the thin, flexible sheets 12 and 14 surrounding the strips 40 and 42 defining an inner tube air valve structure.

Referring to FIG. 7, in an alternate embodiment of the invention wherein like numerals indicate like elements for the modified air-bearing patient mover 10', at the longitudinal end 20 of that structure, the thin, flexible films are similarly bonded along the periphery at portions C and D to seal the top, thin, flexible sheet 12 to the bottom, flexible sheet 14 selectively, while allowing unsealed portions, as at portion I to define an outer tube 26 for the air pallet 10'. Instead of having the automatic self-closing air valve at this location, that is, adjacent edge or end 20 of the air-bearing patient mover, an air inlet tube of thin, flexible sheet material is provided as at 50, the tube 50 having an inner end 52 which projects within the outer tube 28 and forms in conjunction with that outer tube 28, an airflow passage permitting air entry to the plenum chamber 16. The outer end 54 of the tube 50, which is dimensioned on the order of the tube 26 and acts as an extension thereof, and is thermally, sealably bonded to portions of the thin, flexible films 12 and 14 as at 12*a*', FIG. 7, bears paired strips similar to strips 40 and 42 of FIG. 3. However, only strip 40 is illustrated, and it is shown as being bonded at its outer end area 40*a*, remote from the plenum chamber and from area I of the air-bearing patient mover 10' to tube 50. There is a second strip underlying the same, identical thereto and conforming to strip 42 of the embodiment of FIG. 3. The strips are not bonded to each other except possibly along longitudinal edges over a portion of the length and are free to move apart in the manner of the patient mover of FIGS. 5 and 6, and are provided with the same elastic memory and being of a less flexible nature than the material forming tube 50 so as to function identically to the valve structure as shown in the embodiment of FIGS. 1-6 inclusive, although, in this case, the valve structure is more remote from the plenum chamber. In fact, this valve structure has application to air pallets in general and may be incorporated within the thin, flexible sheets making up the load-bearing area and the area immediately adjacent the same or by way of a tube, such as tube 50, which extends from the thin flexible sheet or sheets defining the plenum chamber, quite remote from that chamber.

Another important aspect of the present invention is to provide for the comfort of the patient and to limit the messing of the air-patient mover by loss of bodily fluids of the patient and normally in the area of patient contact. In this regard, the illustrated embodiment of the invention, FIG. 1, makes use of a pair of "chucks" 60 which are edge-to-edge located, extending transversely of and overlying the area of perforations 36 of the bottom, thin, flexible sheet 14 constituting the load-bearing area of the patient mover. While two chucks 60 are shown, a single unitary chuck may be provided, and, furthermore, while the chucks, indicated generally at 60, comprise three layers, that is, an underlying film 62 of a liquid impervious plastic, an intermediate rather thick porous absorbent material layer as at 64, and an upper porous gauze layer 66, the impervious film 62 may be eliminated and the top, thin, flexible sheet 12, which is both air and liquid impervious, may function as an integral element of the "chuck." Further, in the illustrated embodiment of the invention, the chucks 60 and 62 are fixed to the outer surface of the top, thin, flexible sheet 12 through the use of pressure-sensitive adhesive constituted by rectangular areas or pads 70, FIG. 3, which mount to at least the corners of the defined plenum chamber 16. Various other means may be provided for fixing or otherwise incorporating the chuck onto the top, thin, flexible sheet 12 within the load-bearing area and overlying the area of perforations 36, or integrating the structure defining plenum chamber with elements of the chuck as constituted by the porous absorbent material both in terms of the interior padding or filling as at 64 and the outer gauze layer 66.

Further, while the corrugated board 34 has been stated as being generally rigid, in similar fashion to most corrugated structures, it has greater resistance to being bent or curved in the direction of corrugations than at right angles thereto, and, in fact, the structure may be such as to permit the air-bearing patient mover to be simply rolled up in the direction of the longitudinal direction, FIG. 1, that is, from one transverse edge 18 toward the other as at 20. The flexible nature of the strips 40 and 42 will permit this rolling up without major interference, although these elements are somewhat stiffer than the material making up the top and bottom, thin, flexible sheets 12 and 14.

Further, while the invention in its illustrated embodiment is disclosed such that separate top and bottom, thin, flexible films 12 and 14 define the plenum chamber and are heavily thermo-bonded about the periphery in areas A, B, C and D purposely to permit these bonded peripheral areas to define pull tabs to permit pulling, as for instance in the direction of arrow T, FIG. 1, to move the patient longitudinally, a flexible bag, such as a garbage bag, may form the basic structure and substitute for the separate, thin, flexible sheets 12 and 14 with equivalent structure provided for generally rigid planar backing member 34, the air inlet and the air pressure self-closing valve.

Further, while air inlets of a valve nature are provided at both ends of the air-bearing patient mover and at all four corners, variations may be employed. The inlets may be centered transversely and may be additionally at one end only of the patient mover as needs decree.

Further, in order to create effectively, pillowing of the flexible sheet material 14 defining one flexible wall plenum chamber and to permit the patient mover to ride over rough surfaces or projections of the generally fixed support surface, such as floor 30, FIG. 4, the perforations 30 are purposely spaced somewhat from the seal lines between the thin, flexible sheets 12 and 14 defining the plenum chamber 16 in the illustrated embodiment, or where the air-bearing patient mover takes the form of a unitary flexible bag, such as a modified garbage bag, equivalent means may be provided. In the illustrated embodiment, therefore, the perforations 36 are spaced from the seal line L, FIG. 3, in plenum chamber 16, defined by area 14*b*, requiring that the patient P be jacked up sufficiently prior to exposing the outer row or rows of perforations 36, whereupon the air escapes as indicated as at 32 to form an air bearing facing the complete structure of the patient mover (except possibly some extremities outside of the load-bearing area defined by the perforations 36 from the underlying relatively fixed support surface or floor 30).

Further, in order to facilitate the maintaining of the patient in a central position as defined by the load-bearing area by way of perforations, it is possible to modify the make-up of the air-bearing patient mover by either forming padded attachments as part of the unit or create air-pressure inflated areas (without escape of air through perforations) much the same as compartmented air spaced in an air float for surfing or an air mattress. As filled or otherwise padded attachments, the attachments could be snapped on or clipped thereto to form a patient movement barrier either to the sides or to the ends of the patient mover. The patient mover could be employed as filed structures for the armed services with air provided by a back carried pack housing, a suitable blower either battery powered or by way of an internal combustion engine. As stated previously, the unit would facilitate the rendering of patients mobile so that the hospital beds can be cleaned up and remade by shifting the patient to a mobile unit adjacent to the patient's bed and effecting a ready transfer. It should be appreciated that the major effort in jacking up and lifting the patient is within the area of the hips and shoulder blades of the patient. Thus, the unit can be specially shaped and can be provided with hand holds or rope grommets as needed. The air-bearing patient mover can be pulled as mentioned previously by simple grasping of the thermo-bonded peripheral edges. Further, straps or tie-downs can be added as desired along with separate or integral air-pressurized pillows at a given end or the sides for stabilizing and centralizing the position of the patient on the patient mover.

Further, while the illustrated embodiments of the invention show essentially a bag underlying the chuck or chucks, one layer of the chuck may constitute one of the two necessary layers to form the bag. The illustrated patient mover is approximately 30 inches long and about 24 inches wide and is employed principally for supporting the hip and shoulder blade areas of the patient within the perforated load-bearing zone. Further, while the corrugated board is shown internally of the bag, it may in fact be bonded to the top of the upper, thin, flexible sheet 12 with the chuck or chucks 60 bonded to and overlying the corrugated board or other board functioning as the relatively rigid backing member.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A low-cost, disposable patient mover of the air-bearing type for minimal friction movement of a medical patient supported by a generally rigid planar backing member over an underlying generally planar fixed support surface, said patient mover including top and bottom walls at least partially defining a plenum chamber, at least said bottom wall being formed of thin flexible material, said bottom wall including a portion bearing small diameter perforations with the perforations opening into the plenum chamber, air dispersion means carried by the patient mover for insuring airflow thorughout the chamber when the patient mover is under load at the time of air pressurization of the plenum chamber, means for controlling pillowing of the flexible material to permit jacking of the backing member and the medical patient sufficient to permit the patient mover to accommodate surface irregularities for both the load support surface and the backing member while preventing ballooning of the flexible material, air inlet means provided to the chamber for permitting air pressurization of the chamber for jacking the load and for subsequent discharge through said perforations to create an air film between the bottom wall and the fixed support surface, said air inlet means comprising at least one outer tube formed of thin flexible material and an inner tube mounted coaxially within the outer tube and comprised of opposed, flexible tongues having a flexibility less than that of the thin flexible material forming said outer tube and being sealed on the outer surface of opposed inner tube portions to said outer tube at the ends remote from the plenum chamber and with the ends proximate to the plenum chamber being free of each other and from said outer tube, and wherein said tongues have an elastic memory such that during air entry into the plenum chamber through the inner and outer tubes, the tongues take the curved configuration of the outer tube and are separated from each other and in contact with said outer tube end, subsequently, after pressurization of the plenum chamber, air tending to escape through said inlet means causes the tongues to move into sealing contact with each other, away from one side of the outer tube and to press against the other side of the outer tube to thereby close off said inlet means.

2. The patient mover as claimed in claim 1, further comprising a porous material pad overlying the load-bearing area of the patient mover as defined by said perforations within the bottom wall such that the porous material pad absorbs any body fluids emitted by the patient and is self-ventilating for improved comfort to the patient in contact therewith.

3. The patient mover as claimed in claim 2, wherein porous material pad comprises a porous fabric chuck integral with the top wall and defining partially said plenum chamber.

4. The patient mover as claimed in claim 1, wherein said top and bottom walls of said patient mover comprise a bag, said generally rigid backing member comprises a generally rigid planar member positioned internally of the bag and having surface irregularities defining transverse air passages and causing the bag thin flexible material to be displaced from contact with the relatively rigid member along portions thereof.

5. The patient mover as claimed in claim 1, wherein said top and bottom walls of said patient mover comprise an air bag defined by separate top and bottom thin flexible sheets bonded about peripheral edges over given surface portions to define said plenum chamber and said outer tube is integrally formed by opposed surface portions of said top and bottom flexible sheets and wherein said inner tube of said inlet means comprises strips of less flexible sheet material sealed along lateral edges at their ends remote from the plenum chamber to opposed surfaces of said top and bottom sheets, respectively.

6. The patient mover as claimed in claim 4, wherein said patient mover air bag comprises separate top and bottom thin flexible sheets thermally bonded along peripheral edges over given surface portions to define said plenum chamber and said outer tube is integrally formed by opposed surface portions of said top and bottom sheets and wherein said inner tube of said inlet means comprises separate overlying strips of less flexible sheet material sealed along lateral edges at their ends remote from the plenum chamber to opposed surface of said top and bottom sheets, respectively.

7. The patient mover as claimed in claim 6 wherein said flexible strips defining said inner tube are rounded on their ends proximate to the plenum chamber.

8. The patient mover as claimed in claim 1 wherein said air inlet means comprises an elongated outer tube sealed to the peripheral edges of said top and bottom sheets and being interposed between said top and bottom sheets and opening at that end to the plenum chamber, and wherein said elongated outer tube remote from said top and bottom flexible sheets carries said inner tube strips, bonded to opposed surface areas of said elongated outer tube, axially remote from the area of contact of said outer tube with said top and bottom sheets.

9. In an air pallet for the frictionless movement of a load supported by a generally rigid planar backing member, over an underlying generally planar fixed support surface, with air pallet comprising top and bottom walls defining a plenum chamber at least said bottom wall being formed of a thin flexible material, said bottom wall including a portion bearing small diameter perforations with the perforations opening into the plenum chamber, air dispersion means carried by the air pallet for assuring air flow throughout the plenum chamber when the air pallet is under load at the time of air pressurization on the plenum chamber, means for controlling pillowing of the flexible material to prevent jacking of the backing member but permit jacking of the backing member and the load sufficient to permit the air pallet to accommodate surface irregularities for both the load support surface and the backing member while preventing ballooning of the flexible material, air inlet means provided to the chamber for permitting air pressurization of the chamber for jacking the load and for subsequent discharge through the perforations to create an air film between the bottom wall and the fixed support surface, the improvement wherein said air inlet means comprises at least one outer tube formed of thin flexible material and an inner tube mounted coaxially within the outer tube and comprised of opposed flexible tongues having flexibility less than that of the thin flexible material forming said outer tube and being sealed on the outer surface of opposed inner tube portions to said outer tube at ends remote from the plenum chamber, the ends proximate to the plenum chamber being free of each other and from said outer tube and wherein said tongues have an elastic memory such that during air entry into the plenum chamber through the inner and outer tubes, the tongues take the curved configuration of the outer tube and separated from each other and lie in contact with said outer tube, and subsequently, after pressurization of the plenum chamber, air tending to escape through the inlet means causes the tongues to move into sealing contact with each other, away from one side of the outer tube and against the other side of the outer tube to thereby close off said inlet means.

* * * * *